United States Patent [19]

Randall

[11] Patent Number: 4,688,925

[45] Date of Patent: Aug. 25, 1987

[54] ELECTROGRAPHIC REPRODUCTION APPARATUS CAPABLE OF PRODUCING DUPLEX COPIES

[75] Inventor: Kent A. Randall, Rochester, N.Y.

[73] Assignee: Eastman Kodak Company, Rochester, N.Y.

[21] Appl. No.: 805,663

[22] Filed: Dec. 6, 1985

[51] Int. Cl.[4] ..... G03G 15/18

[52] U.S. Cl. ..... 355/3 TR; 101/218; 355/3 R; 355/26

[58] Field of Search ..... 355/3 R, 3 TR, 14 TR, 355/14 R, 23-24, 26; 101/217, 218, 229, 231, DIG. 13

[56] References Cited

U.S. PATENT DOCUMENTS

| | | | |
|---|---|---|---|
| 3,452,672 | 7/1969 | Schunemann et al. | 101/229 X |
| 3,536,398 | 10/1970 | Bhagat | 355/26 |
| 3,687,541 | 8/1972 | Aser | 355/14 D |
| 3,690,253 | 9/1972 | Dreyer | 101/217 |
| 3,694,073 | 9/1972 | Bhagat | 355/24 |
| 3,697,171 | 10/1972 | Sullivan | 355/24 X |
| 3,847,478 | 11/1974 | Young | 355/24 X |
| 4,137,844 | 2/1979 | Paulson | 101/218 |
| 4,187,774 | 2/1980 | Iwasa et al. | 355/3 TR X |
| 4,610,201 | 9/1986 | Jeschke | 101/217 |

FOREIGN PATENT DOCUMENTS

| | | | |
|---|---|---|---|
| 960994 | 3/1957 | Fed. Rep. of Germany | 101/231 |

*Primary Examiner*—Arthur T. Grimley
*Assistant Examiner*—Jane K. Lau
*Attorney, Agent, or Firm*—Lawrence P. Kessler

[57] ABSTRACT

In an electrographic reproduction apparatus having a single process assembly for forming transferable images on a member moving along an image travel path, a mechanism for producing duplex copies on receiver sheets moving along a travel path spaced relative to such image travel path. Such mechanism includes a pair of similar doner rollers. The first doner roller is operatively associated with the transferable image-bearing member and located adjacent to one side of the sheet travel path for selectively receiving a transferable image from such member and transferring such image to one side of a receiver sheet moving along the sheet travel path. The second doner roller is operatively associated with the transferable image-bearing member and located adjacent to the opposite side of the sheet travel path for selectively receiving a transferable image from such member and transferring such image to the opposite side of such moving receiver sheet, whereby a duplex copy is produced.

9 Claims, 4 Drawing Figures

ELECTROGRAPHIC REPRODUCTION APPARATUS CAPABLE OF PRODUCING DUPLEX COPIES

BACKGROUND OF THE INVENTION

This invention relates in general to electrographic reproduction apparatus, and more particularly to an electrographic reproduction apparatus having a pair of similar doner rollers for receiving and transferring images to opposite sides of a receiver to produce duplex copies.

Electrographic reproduction apparatus typically produce copies of original information on receiver members, such as cut sheets of plain bond paper for example. Such information copies may be formed on one side of the paper sheets (referred to as simplex copies), or on both sides of such sheets (referred to as duplex copies). Commercial electrographic reproduction apparatus capable of producing duplex copies are generally classified as "two-pass" or "single-pass" apparatus.

In "two-pass" reproduction apparatus, information is electrographically reproduced sequentially on the first sides of sheets which are thereafter collected in an intermediate tray. Such sheets are then sequentially transported from the intermediate tray back through the apparatus to have information respectively reproduced electrographically on the second sides of such sheets. As a result, a relatively long travel path is required for transporting sheets through the reproduction apparatus twice to produce the duplex copies. Therefore, the potential for jams or other sheet handling complications is increased. Moreover, the first completed duplex copy is not available for inspection until after all first side copies are produced. Thus considerable time elapses until the first complete duplex copy is produced, and any errors in such duplex copy are not determined until after all first side copies have already been made.

In "single-pass" reproduction apparatus selected information is electrographically produced respectively on both sides of a sheet during a single pass through such apparatus. While single-pass apparatus are successful in overcoming the noted disadvantages of two-pass electrographic reproduction apparatus, they tend to introduce, in and of themselves, other disadvantages or complications. For example, U.S. Pat. No. 3,775,102 (issued Nov. 27, 1973, in the name of Punnett) shows two separate substantially complete electrographic process assemblies for reproducing information respectively on each side of a sheet. Such duplicative assemblies require precise optical alignment, substantially increase apparatus cost, and add significant complexity (reduced reliability) to the apparatus.

To eliminate duplicative process assemblies, the single-pass reproduction apparatus may employ an electrically biased doner/transfer roller for simultaneously transferring images, corresponding to information to be reproduced, respectively to each side of a sheet, such as shown for example in U.S. Pat. No. 3,847,478 (issued November 12, 1974, in the name of Young). However, the doner/transfer roller is of complex construction and requires accurate bias control to accomplish the simultaneous image transfers. Simplification of the transfer apparatus is accomplished by utilizing spaced conventional transfer apparatus associated with a single electrographic process assembly, such as shown for example in U.S. Pat. No. 4,194,829 (issued Mar. 25, 1980, in the name of Cavagnaro). Such apparatus requires a complex, precisely controllable sheet handling mechanism which turns the sheet over between transfers to reproduce information on each side thereof.

SUMMARY OF THE INVENTION

This invention is directed to a mechanism, in an electrographic reproduction apparatus having a single process assembly for forming transferable images on a member moving along an image travel path, for producing duplex copies on receiver sheets moving along a travel path spaced relative to such image travel path. The construction of such mechanism is simplified in that it includes a pair of similar doner rollers. The first doner roller is operatively associated with the transferable image-bearing member and located adjacent to one side of the sheet travel path for selectively receiving a transferable image from such member and transferring such image to one side of a receiver sheet moving along the sheet travel path. The second doner roller is operatively associated with the transferable image-bearing member and located adjacent to the opposite side of the sheet travel path for selectively receiving a transferable image from such member and transferring such image to the opposite side of such moving receiver sheet, whereby a duplex copy is produced.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
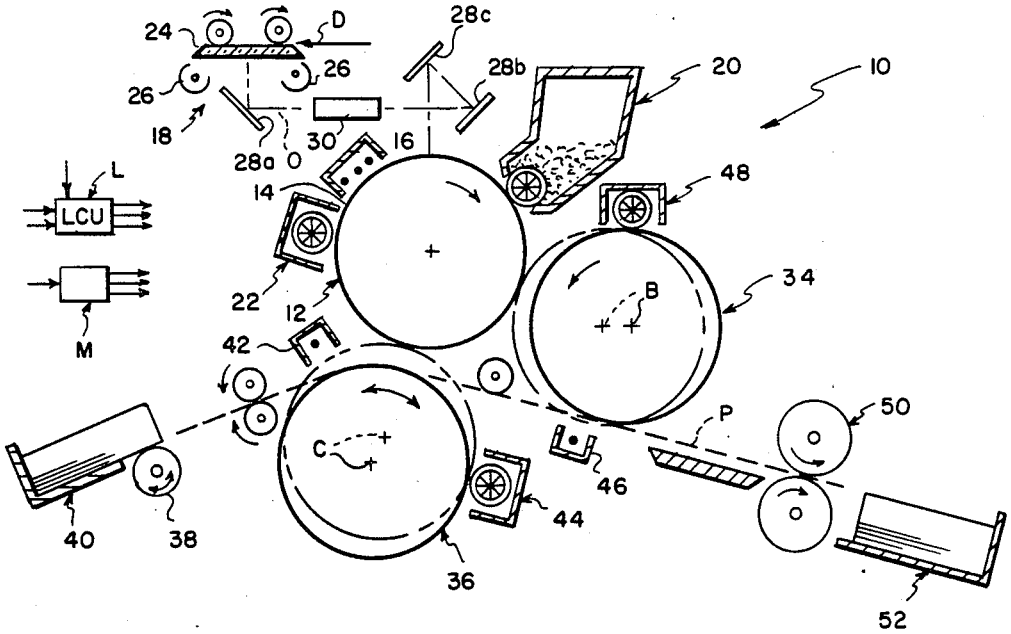
FIG. 1 is a schematic view of an electrographic reproduction apparatus including a mechanism for producing duplex copies according to this invention.

Referring now to the accompanying drawings, an electrographic reproduction apparatus, generally designated by the numeral 10, is schematically shown in FIG. 1. The apparatus 10 includes a member 12, associated with electrographic process stations, upon which marking particle developed, transferable images of original information are formed by the operation of such process stations. The member 12 is, for example, a drum 14 mounted in the apparatus 10 for rotation in a clockwise direction about its longitudinal axis A. The peripheral surface of the drum 14 has a composite construction including a photoconductive layer and a grounding support layer, such as shown in U.S. Pat. No. 3,615,414 (issued Oct. 26, 1971, in the name of Light) for example. Of course, the member 12 could alternatively comprise a closed loop web formed of similar composite construction. The electrographic process stations include a charging apparatus 16, an exposure mechanism 18, a developer apparatus 20, and a cleaning mechanism 22.

Under the control of a logic and control unit L, a motor M rotates the drum 14 through operative relation with the electrographic process stations. The unit L includes, for example, a microprocessor receiving operator input signals and timing signals based on the angular position of the drum about its axis A. Based on such signals and a program for the microprocessor, the unit L produces signals to control the rotation of the drum 14 and the operation of the various electrographic process stations for carrying out the reproduction process. The production of a program for a number of commercially available microprocessors such as INTEL model 8080 or model 8085 microprocessor (which along with others are suitable for use with the invention), is a conventional skill well understood in the art. The particular details of any such program would, of course, depend on the architecture of the designated microprocessor.

In the particular operation of the apparatus 10, the motor M rotates the drum 14 in a clockwise direction to move a portion of the photoconductive layer of its peripheral surface past the charging apparatus 16 which is, for example, a corona charger electrically coupled to a potential source (not shown). The charging apparatus 16 deposits a uniform electrostatic charge on such portion of the drum surface, and such portion then moves past the exposure mechanism 18. The mechanism 18 includes, for example, a transparent platen 24 across which documents containing information to be reproduced are transported in the direction of arrow D by friction rollers R. Lamps 26 illuminate a document transported across the platen 24, and a reflected light image of such document is projected along an optical path 0 via mirror 28*a*, selfoc lens 30, and mirrors 28*b* and 28*c* onto the photoconductive layer of the peripheral surface of the rotating drum 14. The transport of the document and the rotation of the drum 14 are timed such that the peripheral speeds of the document and the drum surface are substantially equal but in opposite directions. Accordingly, line segments of the reflected light image of the document information expose the photoconductive layer and alter the uniform charge pattern thereon to form a right-reading charge pattern corresponding to such image without smearing. Of course other optical, electrical, or electrostatic exposure mechanisms for forming right-reading charge patterns on the photoconductive layer corresponding imagewise to information to be reproduced are suitable for use with this invention.

After the charge pattern is formed on the photoconductive layer, the portion of the surface of the drum 14 bearing such pattern is moved into operative contact with the developer apparatus 20. The developer 20, which may be, for example, a magnetic brush developer of the type described in U.S. Pat. No. 3,457,900 (issued July 29, 1969 in the name of Drexler), brings pigmented marking particles into contact with the photoconductive layer. Such particles adhere to the charge pattern on such layer to develop the pattern into a transferable image. The transferable image is selectively received by one doner roller 34 or a similar doner roller 36 described in detail hereinbelow. Once the transferable image is received by doner roller 34 or doner roller 36, the portion of the photoconductive layer from which such image was removed is cleaned of any residual marking particles by the cleaning mechanism 22 (a rotating fur brush for example) and returned to a location relative to the charging apparatus 16 for reuse.

The doner roller 34 is supported in the apparatus 10 for rotation about its longitudinal axis B, and translational movement between its solid line position and its phantom line position (of FIG. 1). The location of the doner roller 34 is selected such that it is in juxtaposition with one side of a receiver sheet travel path P, and in its phantom line position it is in juxtaposition with the drum 14 and in its solid line position it is remote from the drum 14. The doner roller 34 has a peripheral surface exhibiting properties which enable it to selectively hold or release marking particles under the influence of an electrostatic field.

Similarly, the doner roller 36 is supported in the apparatus 10 for rotation about its longitudinal axis C, and translational movement between its solid line position and its phantom line position (of FIG. 1). The location of the doner roller 36 is selected such that it is in juxtaposition with the opposite side of the receiver sheet travel path P from roller 34, and in its phantom line position it is in juxtaposition with the drum 14 and in its solid line position it is remote from the drum 14. The doner roller 36 also has a peripheral surface exhibiting properties which enable it to selectively hold or release marking particles under the influence of an electrostatic field. Of course, donor rollers 34 and 36 could alternatively be in the form of webs instead of rollers without departing from this invention. Further, roller 34 could be of substantially less diameter then roller 36 since it is not required that roller 34 store an entire image before transfer.

Figure 2:
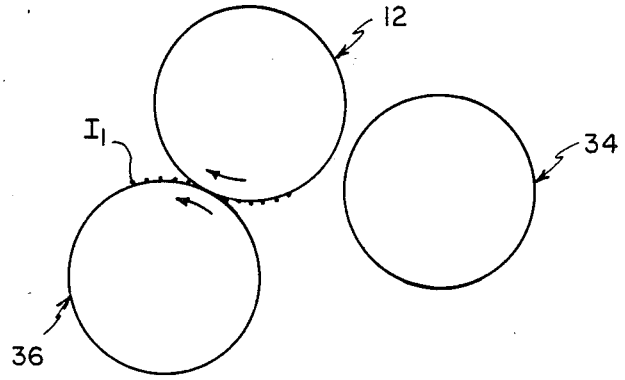
FIGS. 2 through 4 are schematic views of such duplex producing mechanism, with portions removed to facilitate viewing, respectively showing sequential stages of operation of such mechanism.

In order to produce duplex copies with the apparatus 10, a first right-reading transferable image corresponding to information to the reproduced (e.g. information of a first document or back side of a duplex document) is formed on the photoconductive layer of drum 14. Substantially simultaneously, the doner roller 34 is moved to its position remote from the drum, and doner roller 36 is moved to its Position in juxtaposition with the drum (see Fig. 2). The doner roller 36 is rotated in a counterclockwise direction, for example by the motor M, at a peripheral speed substantially matching the peripheral speed of the drum 14, and has a D.C. or biased A.C. electrical potential applied to its surface. Such potential is selected to be of sufficient strength to attract the first transferable image (e.g. image $I_1$) from the peripheral surface of the drum 14 to be received, wrong reading, on the peripheral surface of the doner roller 36. When such transferable image is completely received by the doner roller 36, such roller is moved to its position remote from the drum 14.

Substantially simultaneously a second right-reading transferable image corresponding to information to be reproduced (e.g. information of a second document or the front side of the duplex document) is formed on the photoconductive layer of the peripheral surface of drum 14, and the doner roller 34 is moved to its position in juxtaposition with the drum. The doner roller 34 is rotated in a counter-clockwise direction, for example by the motor M, at a peripheral speed substantially matching the peripheral speed of the drum 14, and has a D.C. or biased A.C. electrical potential applied to its surface. Such potential is selected to be of sufficient strength to attract the second transferable image (e.g. image $I_2$) from the peripheral surface of the drum 14 to be received, wrong reading, on the peripheral surface of the doner roller 34 (see FIG. 3). While the second transferable image $I_2$ is being received by the doner roller 34, a receiver sheet is fed by a feeder 38 from a stack of sheets supported in a hopper 40 (see FIG. 1) into the sheet travel path P.

Figure 3:
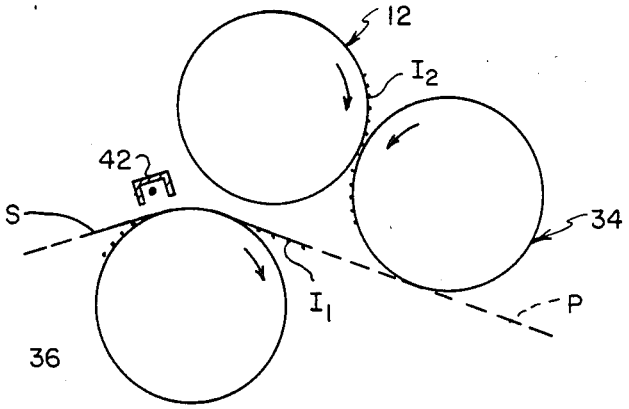

Under control of the unit L, the rotation of the doner roller 36 is reversed (to rotate in a clockwise direction), and its peripheral speed is selected to match the peripheral speed at which the sheet (e.g. sheet S of FIG. 3)

travels along the path P. Further, the contact of the sheet S with the doner roller 36 is timed such that the sheet is in register with the first transferable image $I_1$ on the surface of such doner roller. A corona charger 42 is coupled to a D.C. or biased A.C. electrical potential to establish an electrostatic field of sufficient strength to transfer the wrong reading first transferable image $I_2$ from the doner roller 36 to one side of the moving receiver sheet S where such image is then right reading. Any residual (non-transferred) marking particles are cleaned from the peripheral surface of the doner roller 36 by a cleaning mechanism 44 (see FIG. 1) similar to mechanism 22 for example.

Figure 4:
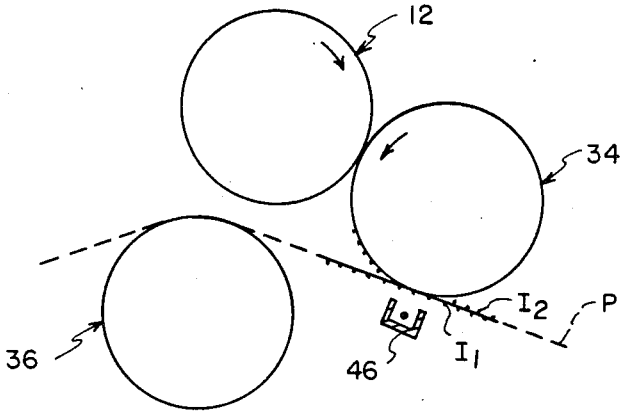

As the receiver sheet S bearing the first transferred image on one side travels along the path P, it is transported into transfer relation with the doner roller 34. The timing is again selected, under the control of unit L, to bring the receiver sheet S into such transfer relation in register with the second transferable image $I_2$. A corona charge 46 is coupled to a D.C. or biased A.C. electrical potential to establish an electrostatic field of sufficient strength to transfer the wrong reading second transferable image $I_2$ from the doner roller 34 to the opposite side of the moving sheet S (see FIG. 4) where such image is then right reading to form a duplex copy. Any residual (non-transferred) marking particles are cleaned from the peripheral surface of the doner roller 34 by a cleaning mechanism 48 (see FIG. 1) also similar to mechanism 22 for example. As the peripheral surfaces of the doner rollers 34 and 36 are being cleaned in preparation for reuse, the receiver sheet bearing the transferred images on both sides thereof (i.e., the duplex copy) is transported through an assembly 50 (see FIG. 1) where such images are fixed to the receiver sheet by heat and/or pressure for example. The receiver sheet is then transported to an output hopper 52 for operator retrieval, and the apparatus 10 is readied for producing a subsequent duplex copy of similar or different information.

The invention has been described in detail with particular reference to preferred embodiment thereof, but it will be understood that variations and modifications can be effected within the spirit and scope of the invention.

I claim:

1. In an electrographic reproduction apparatus including means for forming transferable images on a member moving along an image travel path, means for producing duplex copies on receiver sheets moving along a sheet travel path in spaced relation to such image travel path, said duplex copy producing means comprising:

first doner means, operatively associated with said moving member and located adjacent to one side of said sheet travel path, for selectively electrographically transferring a transferable image from said moving member thereto and thereafter electrographically transferring such image to one side of a receiver sheet moving along such sheet travel path; and second doner means, operatively associated with said moving member and located adjacent to the opposite side of said sheet travel path, for selectively electrographically transferring a transferable image from said moving member thereto and thereafter electrographically transferring such image to the opposite side of such moving receiver sheet, whereby a duplex copy is produced.

2. The invention of claim 1 wherein said first doner means is a roller selectively movable to a first position in engagement with said moving member in timed relation to the approach of a desired transferable image to be received by such roller at such engagement location, and movable to a second position remote from engagement with said moving member after such image is fully received by such roller.

3. The invention of claim 2 wherein said second position is located such that a portion of said sheet travel path is coincident with an arcuate portion of the peripheral surface of said roller.

4. The invention of claim 3 further including means for rotating said roller about its longitudinal axis in a first direction when said roller in its first position at a peripheral speed substantially matching the speed of said moving member to receive such transferable image from said moving member, and rotating said roller about its longitudinal axis in the opposite direction when said roller is in its second position at a peripheral speed substantially matching the speed of such moving receiver sheet to transfer such received image to such moving receiver sheet.

5. The invention of claim 1 wherein said second doner means is a roller selectively movable to a first position in engagement with said moving member in timed relation to the approach of a desired transferable image to be received by such roller to such engagement location, said first position being also located such that a portion of said sheet travel path is coincident with an arcuate portion of the peripheral surface of said roller, and said roller is movable to a second position remote from engagement with said moving member after such received image is fully transferred to such moving receiver sheet.

6. The invention of claim 1 wherein said first and second doner means include first and second rollers respectively, means for moving said first roller to a first position in engagement with said moving member in timed relation to the approach of one transferable image to such engagement location and to a second position remote from engagement with said moving member after such image is fully received by said first roller, and means for moving said second roller to a first position in engagement with said moving member in timed relation to the approach of another transferable image to such engagement location and to a second position remote from engagement with said moving member after such image is received by said second roller and transferred to such moving receiver sheet.

7. The invention of claim 6 wherein said second position of said first roller is located such that a portion of said sheet travel path is coincident with an arcuate portion of the peripheral surface of said first roller, and said first position of said second roller is located such that a portion of said sheet travel path is coincident with an arcuate portion of the peripheral surface of said second roller.

8. The invention of claim 7 wherein when said first roller is in said first position, said second roller is in said second position, and when said first roller is in said second position said second roller is in said first position.

9. The invention of claim 8 further including means for rotating said first roller about its longitudinal axis in a first direction at a peripheral speed substantially matching the speed of said moving member when said first roller is in its first position to receive said one transferable image from said moving member, and rotating said first roller about its longitudinal axis in the opposite direction at a peripheral speed substantially matching the speed of such moving receiver sheet when said first roller is in its second position to transfer such received image to such moving receiver sheet.

* * * * *